US011490713B2

(12) United States Patent
Stewart-Stand et al.

(10) Patent No.: US 11,490,713 B2
(45) Date of Patent: Nov. 8, 2022

(54) COLLAPSIBLE DRINKING CUP

(71) Applicants: Theo Andreas Stewart-Stand, Brooklyn, NY (US); Christopher F. Mignano, Staten Island, NY (US)

(72) Inventors: Theo Andreas Stewart-Stand, Brooklyn, NY (US); Christopher F. Mignano, Staten Island, NY (US)

( * ) Notice: Subject to any disclaimer, the term of this patent is extended or adjusted under 35 U.S.C. 154(b) by 242 days.

(21) Appl. No.: 16/901,096

(22) Filed: Jun. 15, 2020

(65) Prior Publication Data

US 2021/0361053 A1 Nov. 25, 2021

Related U.S. Application Data

(60) Provisional application No. 63/029,204, filed on May 22, 2020.

(51) Int. Cl.

| | |
|---|---|
| ***A45F 3/20*** | (2006.01) |
| ***A47G 19/22*** | (2006.01) |
| ***B65D 6/16*** | (2006.01) |
| ***B65D 21/08*** | (2006.01) |
| ***B65D 41/02*** | (2006.01) |

(52) U.S. Cl.

CPC ..... *A45F 3/20* (2013.01); *A47G 19/22* (2013.01); *B65D 21/086* (2013.01); *B65D 41/023* (2013.01); *A45F 2003/205* (2013.01); *A47G 2019/2277* (2013.01); *B65D 2251/20* (2013.01)

(58) Field of Classification Search

CPC ..... A45F 3/20; A45F 2003/205; A47G 2019/2277; A47G 19/22; B65D 1/0292; B65D 21/086; B65D 41/023; B65D 2251/20; F16M 11/40

USPC ..... 220/8, 6, 666; 222/92; 215/900; 229/405; 206/218

See application file for complete search history.

(56) References Cited

U.S. PATENT DOCUMENTS

| | | | | | |
|---|---|---|---|---|---|
| 248,867 | A | * | 11/1881 | Lomax | B65D 1/04 215/374 |
| 296,902 | A | * | 4/1884 | Wirz | B65D 21/086 220/8 |
| 577,764 | A | * | 2/1897 | Lines | B65D 21/086 220/8 |
| 761,559 | A | * | 5/1904 | Totten | F24C 3/14 220/8 |
| 1,048,935 | A | * | 12/1912 | Brady | B65D 21/086 220/8 |
| 1,093,873 | A | * | 4/1914 | Mitchell | B65D 21/086 220/8 |
| 1,228,706 | A | * | 6/1917 | Smythe | B65D 21/086 5/256 |
| 1,233,117 | A | * | 7/1917 | Parker | B65D 37/00 220/904 |

(Continued)

*Primary Examiner* — Gideon R Weinerth
(74) *Attorney, Agent, or Firm* — Andrew Wilford

(57) ABSTRACT

A collapsible cup has a tubular body having an upper end and a lower end, centered on an axis, and formed with a plurality of helicoidal ridge formations spaced angularly around the tubular body and each extending between the ends of the body. A floor of greater rigidity than the body closes the lower end of the body. A ring reinforces the upper end of the body. The body and ridges are formed of an elastically deformable synthetic resin such opposite angular twisting of the upper and lower ends axially compresses together the upper and lower ends and moves upper end down close to the lower end.

8 Claims, 3 Drawing Sheets

(56) References Cited

U.S. PATENT DOCUMENTS 1,264,040 A * 4/1918 Fackler ..... B65D 21/086 220/8
1,464,548 A * 8/1923 Stephens ..... A47J 47/18 220/8
1,581,418 A * 4/1926 Baker ..... A45F 3/20 229/400
2,886,084 A * 5/1959 Davison ..... B65D 21/086 220/666
3,946,903 A * 3/1976 Parker ..... B65D 1/0292 222/92
4,408,644 A * 10/1983 Svantesson ..... A47G 19/2205 D7/533
4,872,576 A * 10/1989 Nakamura ..... B65D 21/086 220/907
4,930,644 A * 6/1990 Robbins, III ..... B65D 1/40 220/8
8,684,230 B1 * 4/2014 Greenberg ..... A47K 5/122 222/107
10,694,835 B2 * 6/2020 Peterson ..... A45C 11/00
D940,506 S * 1/2022 Singlaub ..... A61J 9/005 D7/532
11,284,525 B2 * 3/2022 Hamilton ..... H04M 1/04
2003/0160055 A1 * 8/2003 Stewart-Stand ..... A45F 3/20 220/666
2013/0032592 A1 * 2/2013 Lee ..... B65D 21/086 220/8
2013/0075393 A1 * 3/2013 Haynie ..... B65D 1/0292 220/6
2014/0332528 A1 * 11/2014 Blum ..... A45F 3/20 220/8
2015/0253055 A1 * 9/2015 Tsui ..... B65D 43/02 280/655
2015/0313389 A1 * 11/2015 Velasquez ..... A61J 9/005 220/717
2016/0309930 A1 * 10/2016 Stewart ..... A45F 3/20
2017/0253363 A1 * 9/2017 Feeley ..... A45F 3/20
2018/0194517 A1 * 7/2018 Brooks ..... B65D 47/089
2020/0062469 A1 * 2/2020 Gabriel ..... B65D 51/228
2020/0231324 A1 * 7/2020 Swarts ..... A45F 3/20
2020/0305619 A1 * 10/2020 Tsui ..... A45F 3/20
2021/0237933 A1 * 8/2021 Swarts ..... B65D 21/08
2021/0361053 A1 * 11/2021 Stewart-Stand ..... A47G 19/22
2022/0227530 A1 * 7/2022 Cheetham ..... A45F 3/20

* cited by examiner

FIG 2A
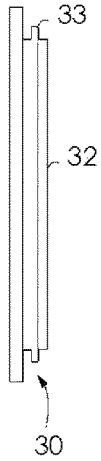
FIG 2B
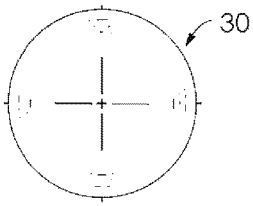
FIG 2C
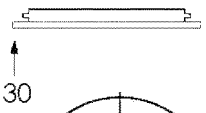
FIG 2D
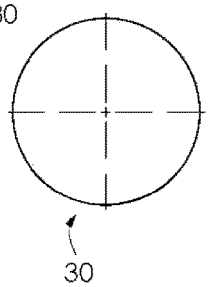
FIG 2E
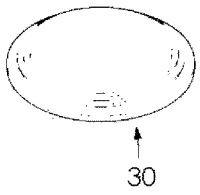
FIG 3A
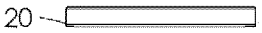
FIG 3B
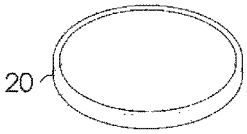
FIG 3C
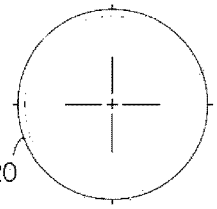
FIG 4A
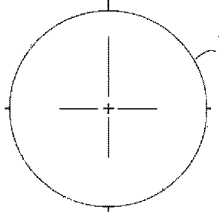
FIG 4B
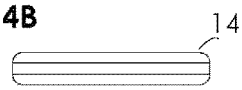
FIG 4D
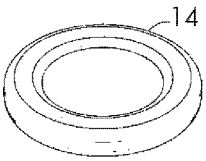
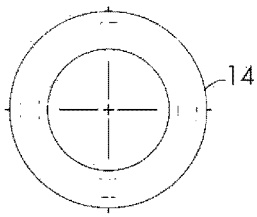
FIG 4C FIG 5A
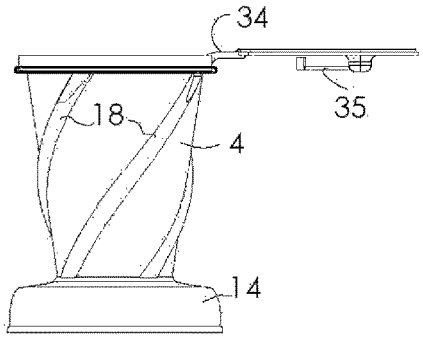
FIG 5B
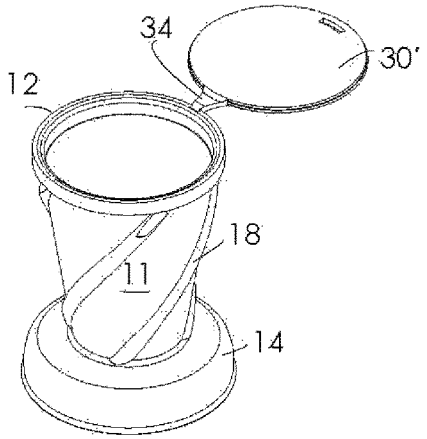
FIG 5C
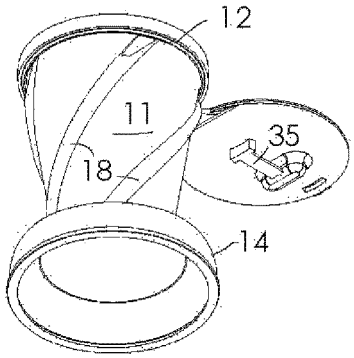
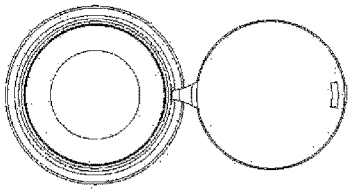
FIG 5D
FIG 5E
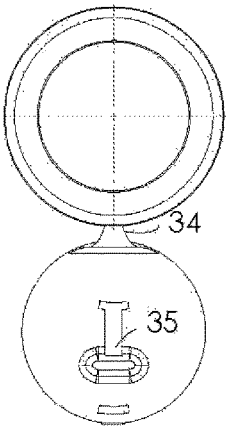
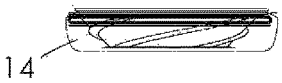
FIG 6A
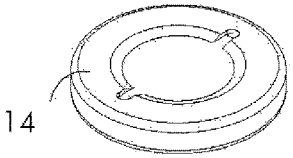
FIG 6B

COLLAPSIBLE DRINKING CUP

CROSS REFERENCE TO RELATED APPLICATION

This application relates back to provisional application 63/029,204 filed 22 May 2020.

FIELD OF THE INVENTION

The present invention relates to a drinking cup. More particularly this invention concerns such a cup that can be collapsed to a smaller size when not in use.

BACKGROUND OF THE INVENTION

People all around the world require easy access to containers for beverages, whether morning coffee, drinking water, or juice. Lifestyle choices and the hustle and bustle of life require that these containers either be temporary or easy to store without any hassle. Currently marketed reusable bottles and coffee cups are bulky and difficult to store, even when empty, and with the recent banning of single use plastics and other culinary ware in numerous jurisdictions, plastic bottles are on their way out as well.

Simultaneously, a large amount of attention has been drawn to the problem of environmental destruction. Other collapsible drinking wares do exist, but even in their collapsed states are bulky, limited in capacity, and inconvenient to use.

OBJECTS OF THE INVENTION

It is therefore an object of the present invention to provide an improved collapsible drinking cup.

Another object is the provision of such an improved collapsible drinking cup that overcomes the above-given disadvantages, in particular that safe, reusable, and whose size can be significantly reduced for storage, shipping, or use by, for example, a camper.

SUMMARY OF THE INVENTION

A collapsible cup has according to the invention a tubular body having an upper end and a lower end, centered on an axis, and formed with a plurality of helicoidal ridge formations spaced angularly around the tubular body and each extending between the ends of the body. A floor of greater rigidity than the body closes the lower end of the body. A ring reinforces the upper end of the body so that the upper and lower ends are significantly stiffer and less elastically deformable than therebetween. The body and ridges are formed of an elastically deformable synthetic resin such opposite angular twisting of the upper and lower ends axially compresses together the upper and lower ends and moves the upper end down close to the lower end.

According to the invention the body is unitarily formed with the ridges and floor. The floor's greater rigidity than the body is achieved by making it much thicker, which makes the cup bottom-heavy and very stable.

In accordance with the invention the body is frustoconical and flares from the lower end to the upper end. What is more the body and ridges are of the same wall thickness such that each ridge forms in the cup a respective radially inwardly open groove. These ridges are responsible for the extremely compact axial compression of the cup, with the ends rotating oppositely relative to each other with axial compression.

The upper end of the cup body is formed with a circularly annular U-section rim centered on the axis forming an axially open annular groove in which the ring is seated. This opens downward toward the lower end to keep the ring out of contact with the user of the cup.

The lower end of the cup body is formed according to the invention with an invertable U-section rim flange forming a radially inwardly open groove. Thus, when the body is axially compressed with the upper end closely juxtaposed with the lower end, the rim flange is invertable from a position with its groove open radially inward below the floor to a position overlying an upper edge of the upper end and also of U-section and open radially inward, but above the floor.

The collapsible cup of the invention further has a cap sealingly fittable with the upper end. In the compacted position when held closed by the inverted lower rim flange, the outer edge of the cap is held by the inverted lower rim flange down on the upper end of the body. This cap can be made out of the same plastic as the cup body, or can even be at least partially of wood.

The cap of this invention is formed with an axially downwardly extending projection fittable loosely in the upper end of the body and itself formed with a radially outwardly projecting lip compressible when the cap is fitted into the upper end against an inner edge of the upper end.

The beneficial novelty of the invention in question is that due to the unique geometry of the middle portion of the cup body, the malleable nature of the bottom portion, and the hard structural properties of the top section reinforced by the ring, the silicone cup can be twisted and collapsed down for convenience and space saving. The cup is designed so that in its collapsed orientation it can easily fit in a pocket. The fluid-tight lid is provided to ensure that no fluid leaks out once collapsed. The lid is also hollowed out in the center to form a cavity for cup material to fit in once collapsed. The hard metal ring works in conjunction with the novel mushroom-shaped bottom section of the cup body to hold all components together.

BRIEF DESCRIPTION OF THE DRAWING

The above and other objects, features, and advantages will become more readily apparent from the following description, reference being made to the accompanying drawing in which:

FIG. 2A is a side view of the cap of this invention;

FIGS. 2B, 2C, and 2D are bottom, side, and top views of the cap;

FIG. 2E is a perspective view of the cap;

FIG. 3A is a side view of the reinforcing ring of the inventive cup;

FIG. 3B is a perspective view of the FIG. 3A ring;

FIG. 3C is a top view of the FIG. 3A ring, the top view being identical;

FIG. 4A is a bottom view of the fully collapsed cup;

FIGS. 4B and 4C are side and top views of the FIG. 4A collapsed cup;

FIG. 4D is a perspective view from above of the FIG. 4A collapsed cup;

FIG. 5A is a side elevational view of another inventive cup;

FIGS. 5B and 5C are perspective views of the cup as shown in FIG. 5A from above and from below;

FIGS. 5D and 5E are bottom and top views of the FIG. 5A cup;

FIG. 6A is a sectional view through the cup of FIG. 4A when closed and collapsed; and FIG. 6B is a perspective view from above of the collapsed cup of FIGS. 5A-E.

SPECIFIC DESCRIPTION OF THE INVENTION

Figure 1A:
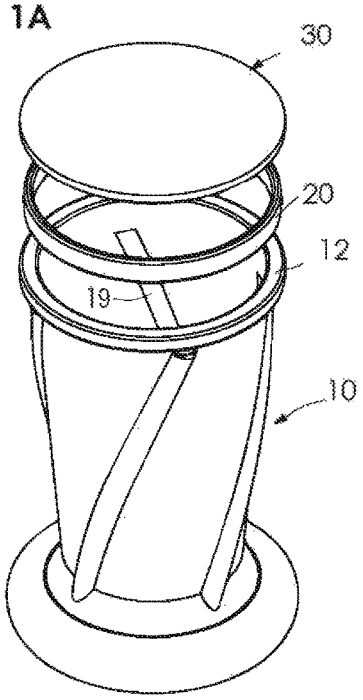
FIG. 1A is an exploded perspective view from above of the inventive cup.
Figure 1B:
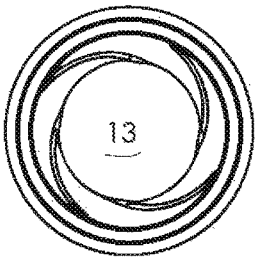
FIG. 1B is a top view of the body of the cup.
Figure 1C:
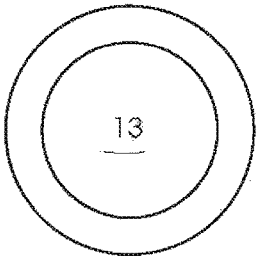
FIG. 1C is a bottom view of the cup.
Figure 1D:
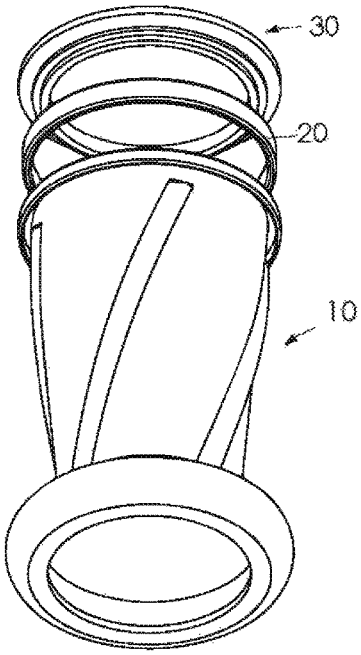
FIG. 1D is an exploded side elevational view of the cup.
Figure 1E:
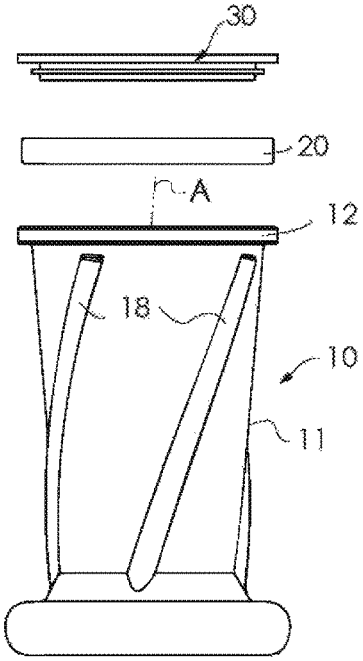
FIG. 1E is a side exploded view of the cup.
Figure 1F:
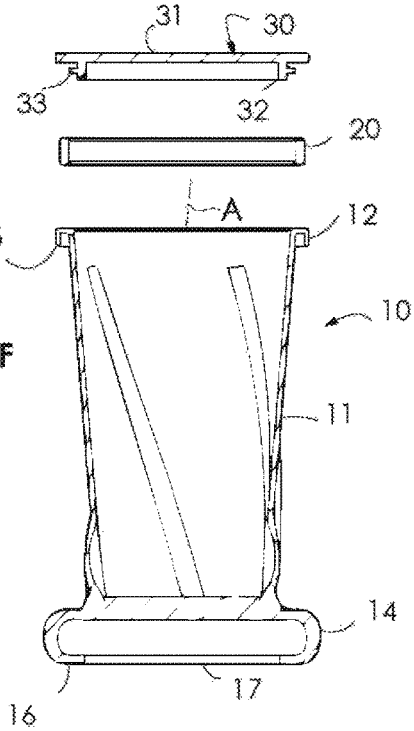
FIG. 1F is a view like FIG. 1E but in vertical section through the cup.

As seen in FIGS. 1A-1F, a collapsible cup according to the invention has a cup body 10, a reinforcement ring 20, and a cap 30.

The body 10 has an upwardly flaring frustoconical side wall 11 centered on an axis A and terminating at an upper rim 12 that is bent over to form a downwardly open groove 15. The wall 11 is closed downwardly at its lower end by a thick floor 13 from which projects a downwardly open annular flange 14 forming a radially inwardly open groove 16 and a downwardly open hole 17 of roughly the same inner diameter as an outer diameter of the body 10 at the floor 13. The floor 13 is a disk having planar upper and lower faces extending perpendicular to the axis A.

In addition and importantly to the invention, the side wall 11 is formed with a plurality, here four, of spiral or helical ridge formations 18 that are angularly equispaced about the axis A and that each extend from the floor 13 up to slightly below the upper rim 12. The side wall 11, including the formations 18, is of uniform wall thickness so that each formation 18 forms a respective inwardly open spiral groove 19.

The entire body 10 is formed of molded food-grade silicone and is sufficiently rigid to stand on its own, but still highly elastically deformable as will be described below.

The ring 20 also shown in FIGS. 3A-3B is of plain construction of metal, preferable aluminum, stainless steel or the like and is quite rigid and only limitedly radially elastically deformable. It is of rectangular section and is normally fitted into the groove 15 formed by the bent-over rim 12, where it is permanently fixed. It serves to reinforce the upper end of the body and hold it in a desired circular shape that cannot be radially expanded.

The cap 30 also shown in FIGS. 2A-2E comprises a flat disk 31 from which downwardly extends a short tubularly cylindrical flange 32 of an outside diameter that is slightly less than an inside diameter of the upper end of the body 10 at the upper rim 12. A planar and annular lip 33 projects radially outward from a cylindrical outer surface of the flange 32. This cap 30 is also molded of one piece from a food-grade silicone that may be of somewhat greater rigidity than the body 10. Thus this cap 30 can fit into the upper end of the body 10 with some radial compression of the seal lip 33 to effectively close the upper end of the cup body 10.

When erect as shown in FIGS. 1A, 1D, 1E, and 1F the cup body 10 can contain a drinkable liquid. When the lid is fitted in place, the liquid is tightly contained.

According to the invention, however, the entire cup can be axial compressed by pushing its upper and lower end faced toward each other in line with the axis A. Due to the presence of the spiral formations 18, this axial compression will cause the upper end to rotate oppositely about the axis A relative to the lower end and ensure that the side wall 11 compacts uniformly until the outwardly projecting spiral formations 18 lie or nearly lie axially one atop the other. In fact this axial compaction can be aided by simultaneously oppositely twisting the upper and lower rims 12 and 14, and in fact such axial opposite twisting will cause the cup body 11 to axially shorten.

In the fully axially compressed condition the flexible lower rim 14 can be inverted to deform up around the upper rim 12 reinforced by the ring 20 and flip over atop it, forming the entire cup into a compact and dimensionally stable coin-shaped body as shown in FIGS. 4A-4E. The cap 30 is normally upwardly closing the body 10 while this is done, but in fact the cup can be axially twist-compacted without the cap 30 in place.

When thus compacted the entire cup with or without its cap can be pocketed or stored in a backpack or the like, taking up very little room. Yet when a cup is needed, the compacted cup can be restored to its erect condition simply by peeling back or de-inverting the inverted lower rim 14, whereupon it will naturally spring elastically back into the full erect position shown in FIGS. 1A and 1D-1F.

FIGS. 5A-F show an alternate model of the cup where instead of a separate cap 30 as described immediately above, there is a simple circular cap 30' that fits tightly within the rim 12 and that is permanently secured to the cup body 11 at the rim 12 by a flexible tongue 34 formed unitarily of molded silicone with the rest of the cup. This cap 30' also has a drink fitting 35 that can be snapped between an open and closed position to allow the liquid to be drunk from the cup without opening it, somewhat in the manner of an infant's sippy cup.

This cup can also be compacted as shown in FIGS. 6A and 6B for packing and transport.

We claim:

1. A collapsible cup comprising:

a tubular body having an upper end and a lower end, centered on an axis, and formed with a plurality of helicoidal ridge formations spaced angularly around the tubular body and each extending between the ends of the body;

a floor of greater rigidity than the body closing the lower end of the body;

a ring reinforcing the upper end of the body, the body and ridges being formed of an elastically deformable synthetic resin such that axially compression together of the upper and lower ends twists the ends angularly oppositely and brings the upper end down close to the lower end, the lower end being formed with an invertible U-section rim flange forming a radially inwardly open groove and, when the body is axially compressed with the upper end closely juxtaposed with the lower end, the rim flange being invertible from a lower position with its groove open radially inward below the floor to an upper position overlying an upper edge of the upper end.

2. The collapsible cup according to claim 1, wherein the body is unitarily formed with the ridges and floor.

3. The collapsible cup according to claim 1, wherein the body is frustoconical and flares from the lower end to the upper end.

4. The collapsible cup according to claim 1, wherein the body and ridges are of the same wall thickness such that each ridge forms in the cup a radially inwardly open groove.

5. The collapsible cup according to claim 1, wherein the upper end is formed with a U-section rim forming an axially open annular groove in which the ring is seated.

6. The collapsible cup according to claim 5, wherein the groove opens downward toward the lower end.

7. The collapsible cup according to claim 1, further comprising:

a cap sealingly fittable with the upper end.

8. The collapsible cup according to claim 7, wherein the cap is formed with an axially downwardly extending projection fittable loosely in the upper end of the body and formed itself with a radially outwardly projecting lip compressible when the cap is fitted into the upper end against an inner edge of the upper end.

* * * * *